US010081987B2

(12) United States Patent
Dirksen

(10) Patent No.: US 10,081,987 B2
(45) Date of Patent: Sep. 25, 2018

(54) SYSTEMS AND METHODS FOR KILLING A WELL

(71) Applicant: Halliburton Energy Services, Inc., Houston, TX (US)

(72) Inventor: Ronald J. Dirksen, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 51 days.

(21) Appl. No.: 15/146,195

(22) Filed: May 4, 2016

(65) Prior Publication Data

US 2016/0251919 A1 Sep. 1, 2016

Related U.S. Application Data

(63) Continuation of application No. 13/807,054, filed as application No. PCT/US2011/042229 on Jun. 28, 2011, now Pat. No. 9,359,874.

(60) Provisional application No. 61/362,825, filed on Jul. 9, 2010.

(51) Int. Cl.

| | |
|---|---|
| ***E21B 17/18*** | (2006.01) |
| ***E21B 21/08*** | (2006.01) |
| ***E21B 21/10*** | (2006.01) |
| ***E21B 43/12*** | (2006.01) |
| ***E21B 47/00*** | (2012.01) |
| ***E21B 47/06*** | (2012.01) |

(52) U.S. Cl.

CPC ..... *E21B 17/18* (2013.01); *E21B 21/08* (2013.01); *E21B 21/10* (2013.01); *E21B 43/12* (2013.01); *E21B 47/00* (2013.01); *E21B 47/06* (2013.01)

(58) Field of Classification Search

CPC ..... E21B 21/10; E21B 57/065; E21B 34/02; E21B 34/08; E21B 47/06; E21B 47/12; E21B 33/13; E21B 17/18; E21B 43/12; E21B 47/00; E21B 21/08

See application file for complete search history.

(56) References Cited

U.S. PATENT DOCUMENTS

| | | | | |
|---|---|---|---|---|
| 3,050,121 | A * | 8/1962 | Garrett | E21B 43/14 166/285 |
| 3,822,745 | A | 7/1974 | Mott | |
| 3,913,668 | A | 10/1975 | Todd et al. | |
| 4,817,719 | A | 4/1989 | Jennings, Jr. | |
| 5,339,905 | A * | 8/1994 | Dowker | E21B 43/122 166/324 |
| 6,179,057 | B1 | 1/2001 | Fontana et al. | |

(Continued)

FOREIGN PATENT DOCUMENTS

| | | |
|---|---|---|
| EP | 1898044 A2 | 3/2008 |
| WO | 2005062749 A2 | 7/2005 |

*Primary Examiner* — Brad Harcourt

(74) *Attorney, Agent, or Firm* — Chamberlain Hrdlicka

(57) ABSTRACT

A well system and associated method, in which a kill weight fluid can be flowed into a wellbore via a flow passage extending from the surface to a downhole location, and prior to the flowing, the flow passage is installed with a casing string into the wellbore. A well system and associated method, in which a flow passage is positioned external to a casing, and wherein a downhole well parameter is measured via the flow passage. Another method can include flowing a kill weight fluid into a wellbore via a flow passage extending along a casing string, the flowing being performed while a formation fluid flows into the wellbore.

15 Claims, 5 Drawing Sheets

(56) References Cited

U.S. PATENT DOCUMENTS

| | | | | |
|---|---|---|---|---|
| 6,253,854 | B1 | 7/2001 | Fenton | |
| 2005/0189107 | A1* | 9/2005 | McVay | E21B 17/1078 166/242.1 |
| 2008/0296062 | A1 | 12/2008 | Horton, III et al. | |
| 2009/0236144 | A1 | 9/2009 | Todd et al. | |
| 2011/0290501 | A1 | 12/2011 | Duncan et al. | |

* cited by examiner

SYSTEMS AND METHODS FOR KILLING A WELL

TECHNICAL FIELD

This disclosure relates generally to operations performed and equipment utilized in conjunction with a subterranean well and, in an example described below, more particularly provides systems and methods for killing a well.

BACKGROUND

If a well is flowing uncontrollably (for example, if a blowout, occurs), it can be extremely difficult to flow kill weight fluid into the well. In situations in which formation fluids are flowing rapidly into a wellbore and to the surface, it may be virtually impossible to force kill weight fluid into the wellbore at the surface (e.g., for either a land-based or subsea facility).

When a severe well control situation occurs, so severe that access to the wellhead and the ability to lower a string of drill pipe or tubing into the well that is blowing out, is impossible, typically the only option is to drill a relief well that intersects the out of control well below the last casing shoe at or above the zone where the borehole fluid influx is occurring, for the purpose of injecting "kill fluid" into the out of control well. This is a time consuming, expensive process, not without risk itself, nor is success 100% guaranteed.

Therefore, it will be appreciated that improvements are needed in the art of killing wells. Such improvements can also be useful in other operations, for example, while drilling and not killing the well.

DETAILED DESCRIPTION

Figure 1:
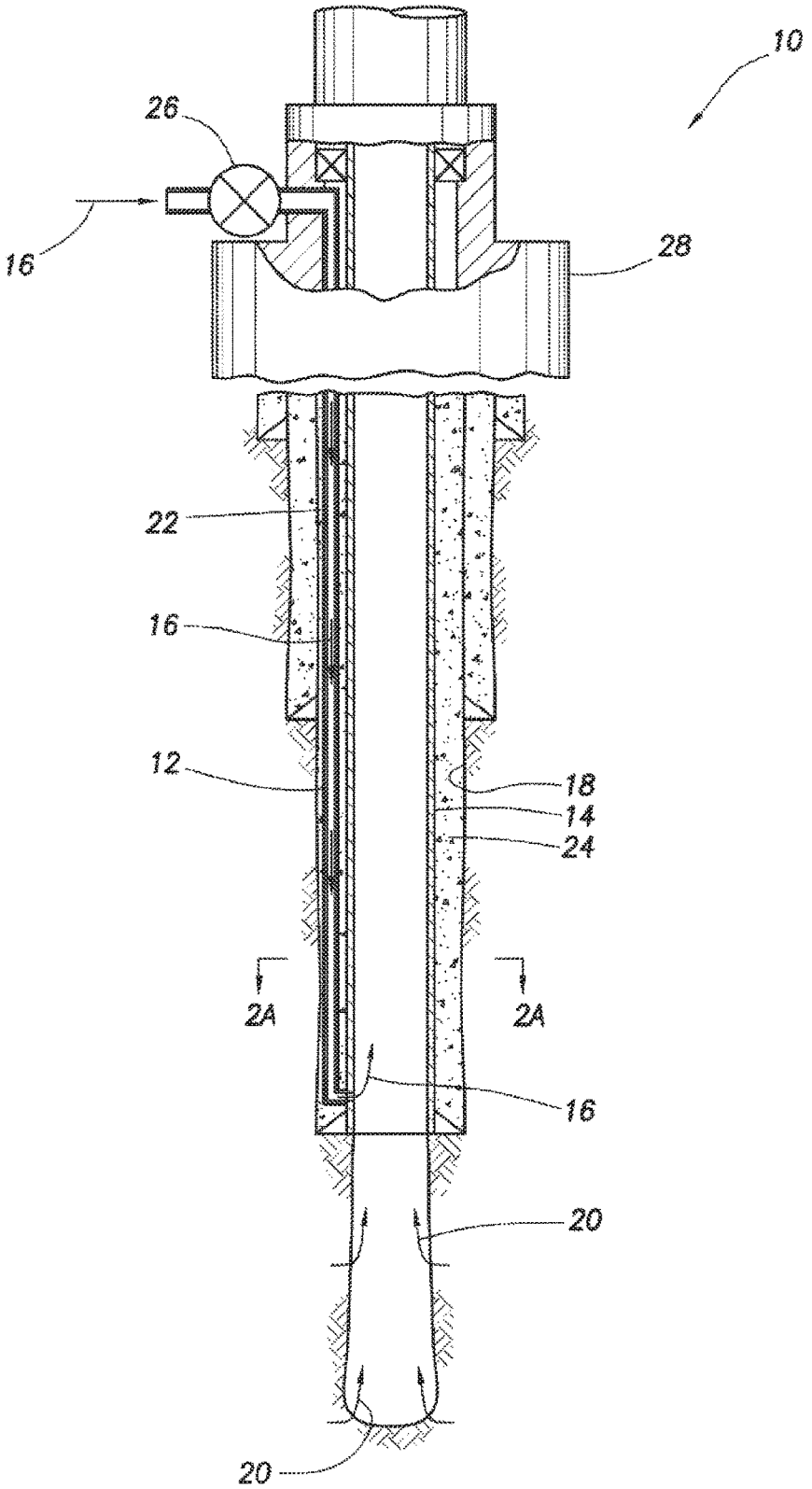
FIG. 1 is a schematic partially cross-sectional view of a well system and associated method embodying principles of the present disclosure.

Representatively illustrated in FIG. 1 is a well system 10 and associated method which can embody principles of this disclosure. As shown in FIG. 1, a conduit or kill string is installed in a wellbore adjacent a casing string and extending to the surface.

In cases where a risk evaluation of a drilling project indicates a significant risk of encountering a well control situation, it may be desirable to pre-install a conduit, accessible from surface, to the bottom of the last casing string to use to inject a kill weight fluid. At a slightly increased cost, a conduit to provide a flow path to the desired location at the bottom of the well is thereby guaranteed, and the conduit is accessible almost immediately, without the need to drill another well.

Instead of trying to flow kill weight fluid into the wellbore at or near the surface, it will be much more effective to flow the kill weight fluid into the wellbore near the bottom of the wellbore, so that as the kill weight fluid column fills the wellbore, enough hydrostatic pressure is eventually generated to stop the flow of formation fluids into the wellbore. For this purpose, at least one flow passage is provided in the well system and method example of FIG. 1 for conducting the kill weight fluid to a location which is preferably: a) near the bottom of the wellbore, b) proximate an influx of formation fluids, and/or c) at a sufficient true vertical depth so that enough hydrostatic pressure can be generated by a column of the kill weight fluid to stop the flow of formation fluids into the wellbore.

The flow passage can be an annular area between two tubular strings (such as concentric casing strings), or in a wall of a tubular string. The flow passage can be in a separate tubular string installed with a casing string (such as, a 2" diameter tubing string cemented in an annulus external to a production casing string, etc.). Multiple flow passages could be provided, if desired.

A valve/injection port can be provided in a wellhead to permit the kill weight fluid 16 to be injected into the flow passage when needed. The flow passage may be filled with fluid (not necessarily kill weight fluid) when the casing string is installed and cemented in the wellbore, in order to prevent collapse of the flow passage and its surrounding tubing or casing string.

In FIG. 1, a tubular kill string or conduit 12 is positioned in an annulus 24 external to an intermediate casing string 14. The conduit 12 is cemented in the annulus 24. The flow passage 22 extends through the conduit 12.

A valve 26 is provided at a wellhead 28 for flowing fluid 16 through the conduit 12. A check valve (not shown) may be provided at a lower end of the conduit 12 to prevent cement or other fluids from flowing into the lower end of the conduit.

Note that, although formation fluid 20 is flowing into the wellbore 18, the kill weight fluid 16 can still be flowed into the lower end of the casing string 14. When a sufficient column of the kill weight fluid 16 is flowed into the casing string 14, it will exert enough hydrostatic pressure to stop the flow of formation fluid 20 into the wellbore 18 (hydrostatic pressure of fluid column>formation pore pressure). This will regain control of the well.

As used herein, the term "casing string" is used to indicate a protective wellbore lining. "Casing" can include elements known to those skilled in the art as casing, liner or tubing. Casing can be segmented, continuous or formed in situ. Casing can include electrical, fluid, optical and/or other types of lines in a wall thereof, and may be instrumented in a manner known to those skilled in the art as "intelligent" casing.

A "kill weight fluid" is a fluid which is used to kill a well, that is, used to generate a sufficient hydrostatic pressure in a wellbore above an influx of formation fluid into the wellbore, so that the influx will cease. A kill weight fluid will typically have a density greater than a drilling fluid circulated through a drill string during normal drilling operations.

Figure 2A:
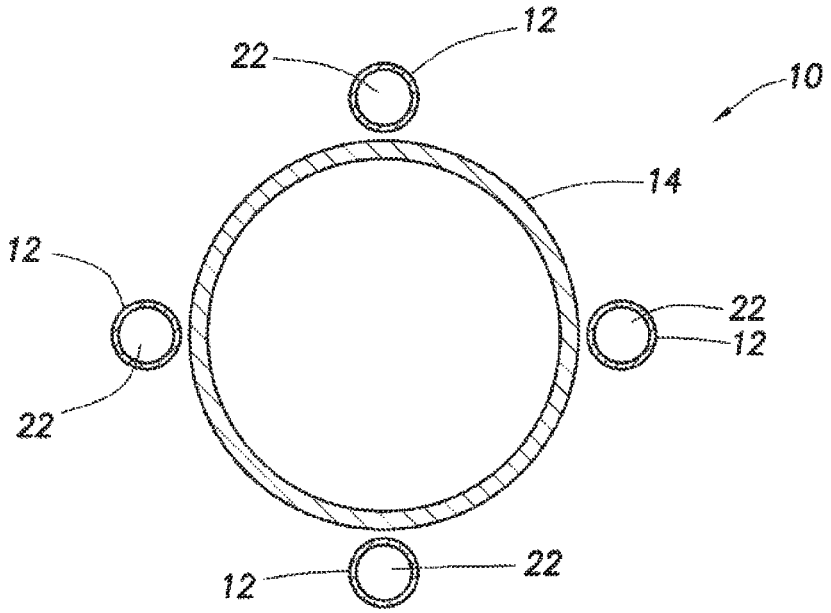
FIG. 2A is an enlarged scale schematic cross-sectional view through the well system, taken along line 2-2 of FIG. 1.

In FIG. 2A, a cross-sectional view is representatively illustrated of a configuration in which multiple conduits 12 are positioned about the casing string 14. Any number and/or location of conduits 12 may be used.

Figure 2B:
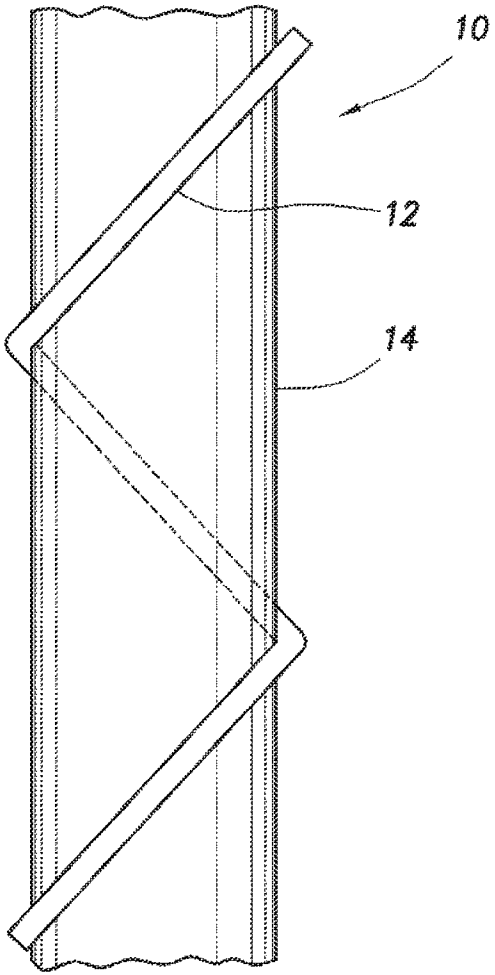
FIG. 2B is a schematic elevational view of a casing string and conduit which may be used in the well system and method of FIG. 1.

In FIG. 2B, one or more conduits 12 are installed in a helical pattern around the casing string 14. It is expected that this should help with getting the casing string 14 in the wellbore 18, with fluid displacement and cementing, and may eliminate the need for casing centralizers.

Figure 3:
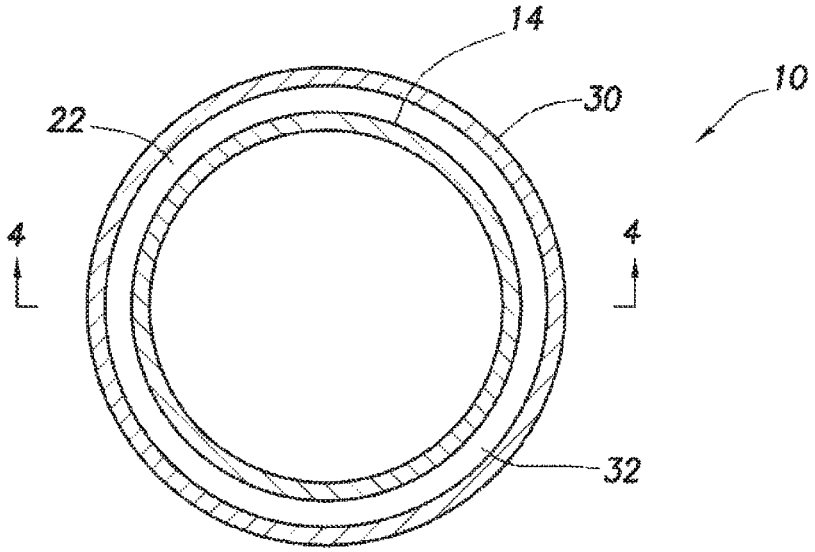
FIG. 3 is a schematic cross-sectional view of another configuration of the casing string and flow passage, taken along line 2-2 of FIG. 1.

In FIG. 3, another configuration is shown in which concentric inner and outer strings 14, 30 are used to create the flow passage 22 in an annular space 32 between the inner and outer strings. Either or both of the inner and outer strings may be casing, liner, tubing, or any other type of tubular string.

Figure 4:
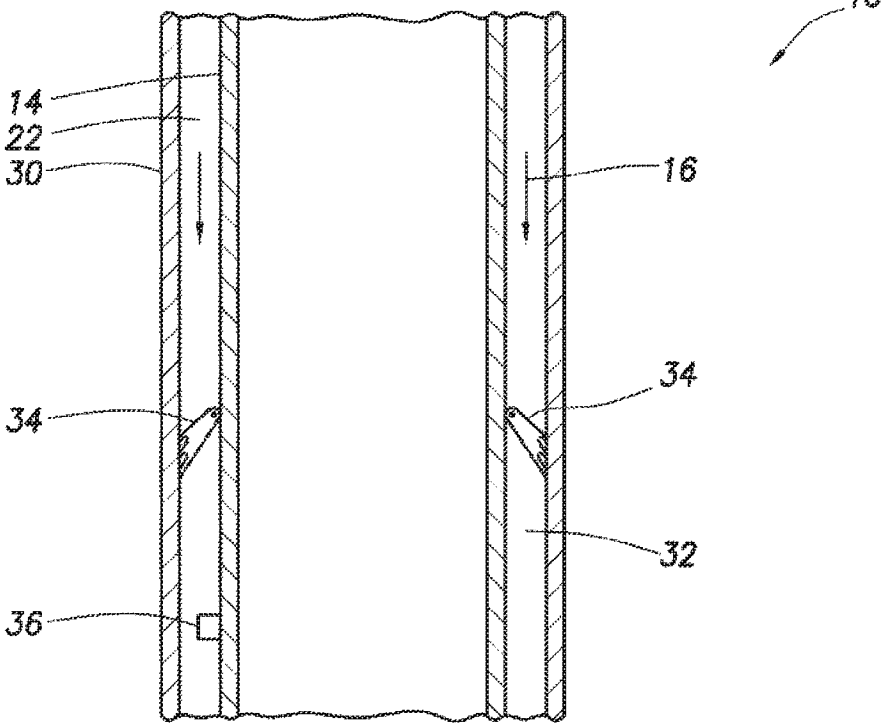
FIG. 4 is a schematic cross-sectional view of the casing string and flow passage, taken along line 4-4 of FIG. 3.

In FIG. 4, a longitudinal cross-sectional view is shown, in which a manner of securing the inner string 14 to the outer string 30 is illustrated. Slips, wedges, or other types of gripping devices 34 are used to prevent the inner string 14 from displacing downward relative to the outer string 30.

Seal(s) may also be provided to seal off the annular space 32 between the inner and outer strings 14, 30. However, when the kill weight fluid 16 is flowed downward through the annular space 32, the slips, other gripping devices 34 and/or seals will preferably pivot or otherwise move out of the way to allow the kill weight fluid to flow relatively unhindered through the annular space.

The kill weight fluid 16 can be flowed directly from the wellhead 28 or other surface location to the bottom of the wellbore 28 (or other sufficiently deep location) via the flow passage 22, so that a column of kill weight fluid 16 can be readily established in the wellbore 28 above the influx of formation fluid 20.

Use of the concentric string 30 or the external conduit 12 means that the flow passage 22 is always available for use when needed, thus, it does not have to be installed later (for example, in an emergency situation, such as a blowout).

Especially in deep water environments (e.g., >500 ft. water depth), it can be difficult to flow sufficient kill weight fluid into a wellbore which is flowing formation fluids uncontrollably to the surface. The examples of systems and methods described here can readily solve this problem.

Figure 5:
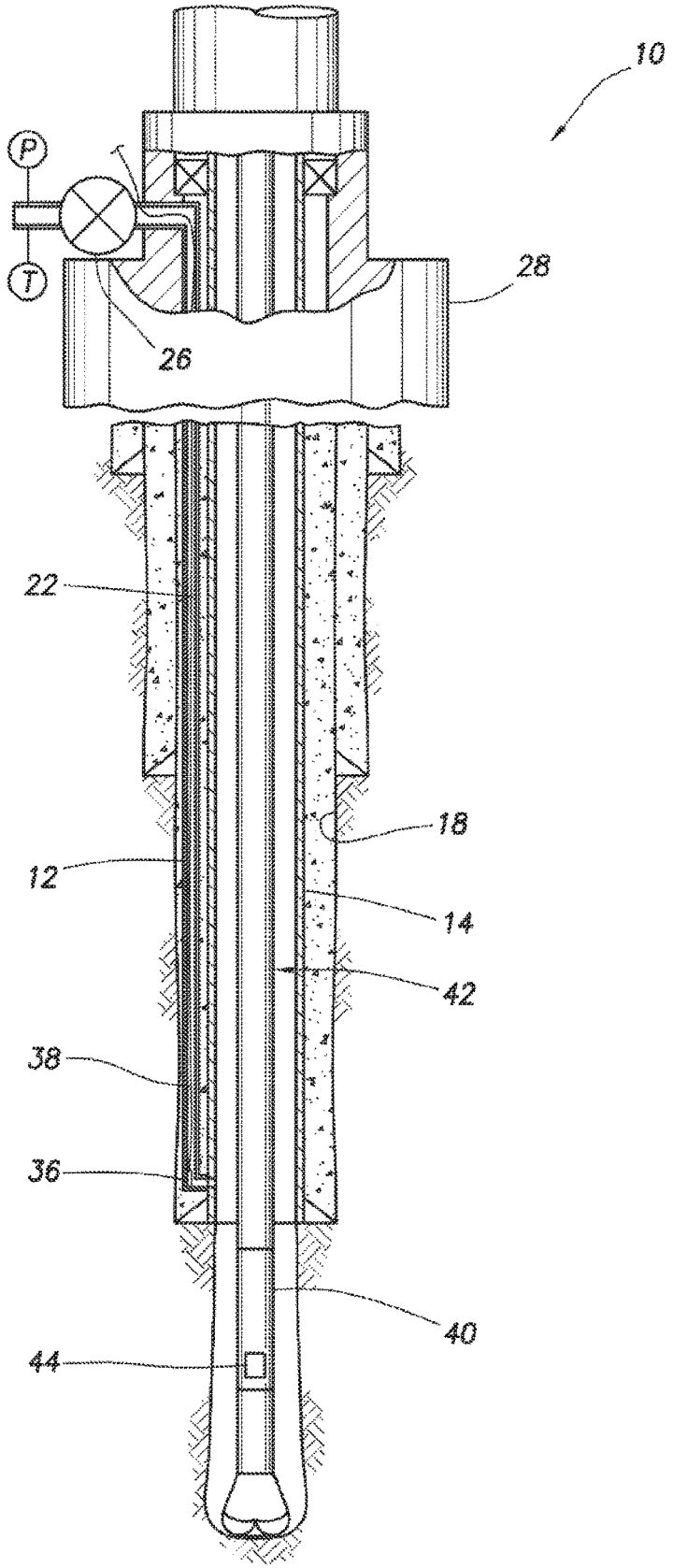
FIG. 5 is a schematic partially cross-sectional view of another configuration of the well system and method.

In FIG. 5, another use is depicted for the flow passage 22 in the conduit, conduit 12 or annular space 32 between inner and outer strings 14, 30. That is, the flow passage 22 can be used for monitoring pressure or any other well parameter(s) near the bottom of the wellbore 18 or near an influx of formation fluids 20, for example, during drilling operations.

Sensors 36 (such as pressure, flow, temperature, etc. sensors) and communication/power lines 38 can also be installed in the passage 22 for the purpose of accessing the data from the sensors installed therein, or to transmit bottomhole assembly (BHA) 40 telemetry data during the drilling operation. Thus, one or more sensors 36 in the conduit, or at least in communication with the flow passage 22, can receive telemetry signals (for example, from logging while drilling (LWD) or measurement while drilling (MWD) or pressure while drilling (PWD) sensors 44 in a bottom hole assembly 40 of a drill string 42) while the wellbore 18 is being drilled.

The sensors 36 may be located at the surface or downhole. A downhole sensor 36 is not necessarily in the conduit or flow passage 22, but could instead be in a sidewall of the casing 14, etc.

Figure 6:
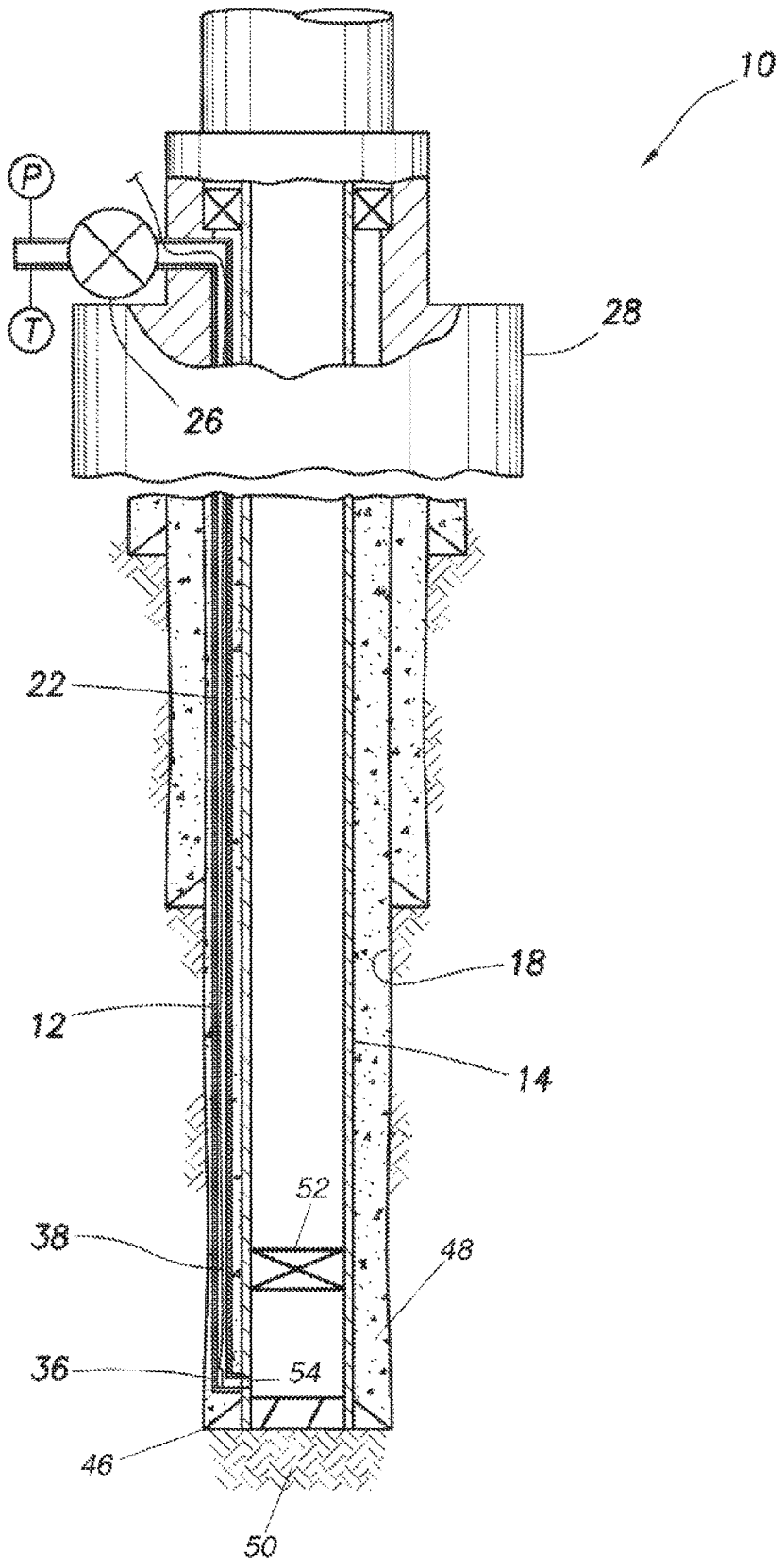
FIG. 6 is a schematic partially cross-sectional view of yet another configuration of the well system and method.

Referring additionally now to FIG. 6, another configuration of the well system 10 and method is representatively illustrated. In this configuration, the flow passage 22 can be used to test a casing shoe 46, cement 48 and/or a formation 50 below the casing shoe. These tests can be conveniently performed prior to drilling out the bottom of the casing shoe 46 and exposing the wellbore 18 to the formation 50 below the casing shoe.

In one example test, a plug 52 can be set in the casing string 14 above a port 54 which provides fluid communication between the flow passage 22 and the interior of the casing string. Pressure can then be applied to the flow passage 22 at the surface and/or pressure in the flow passage 22 can be monitored to test the strength and pressure holding capability of the casing shoe 46, cement 48 and/or formation 50.

In this manner, steps can be taken to mitigate any failure of the tests, and those steps can be taken prior to drilling through the casing shoe.

It may now be fully appreciated that the above disclosure provides significant advancements to the art of killing a well. In the examples described above, a well can be killed readily and efficiently by circulating the kill weight fluid 16 to a location near a bottom end of the casing string 14, near a bottom end of the wellbore 18 and/or at a sufficient depth that the kill weight fluid in the wellbore above an influx of formation fluid 20 will generate sufficient hydrostatic pressure to prevent further influxes.

A well system 10 and associated method are provided by this disclosure. In the well system 10 and method, a kill weight fluid 16 can be flowed into a wellbore 18 via a flow passage 22 extending from a surface location to a downhole location. The flow passage 22 is pre-installed with a casing string 14 in the wellbore 18.

The flow passage 22 can extend through a conduit 12 positioned external to a casing string 14. The conduit 12 can extend helically about or linearly along the casing string 14.

The flow passage 22 can extend through an annular space 32 radially between inner and outer tubular strings 14, 30.

One or more lines 38 may extend through the flow passage 22, for example, to a downhole sensor 36 and/or receiver. The downhole sensor 36 may measure pressure, temperature and/or flow rate downhole. The sensor 36 may be in fluid communication with the flow passage 22.

The sensor/receiver 36 may receive a telemetry signal from a drill string 42. The sensor/receiver 36 may receive a telemetry signal from MWD/LWD/PWD sensors 44 in the drill string 42 (e.g., in the bottom hole assembly 40).

The flow passage 22 can be installed with casing string 14 in water depths of greater than 500 feet.

Another well system 10 and associated method may comprise a flow passage 22 positioned external to a casing string 14, and wherein a downhole well parameter is measured via the flow passage 22. The downhole well parameter may comprise pressure applied to at least one of a casing shoe 46, cement 48, and an earth formation 50.

Another method can include flowing a kill weight fluid 16 into a wellbore 18 via a flow passage 22 extending along a casing string 14, the flowing being performed while a formation fluid 20 flows into the wellbore 18.

As used herein, the term "surface" is used broadly to include locations proximate a surface of the earth, such as a land location, a subsea location, a sea floor or mudline location, etc.

It is to be understood that the various embodiments of this disclosure described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A method for managing a well comprising a wellbore, the method comprising:

supporting the casing string with a gripping device positioned within a flow passage positioned external to a casing string extending into the wellbore to prevent the casing string from displacing within the wellbore;

flowing fluid downhole into the wellbore through the flow passage; and preventing fluid from flowing uphole out of the wellbore through the flow passage.

2. The method of claim 1, wherein the preventing comprises preventing fluid from flowing from the casing string and into the flow passage.

3. The method of claim 1, wherein the preventing comprises preventing fluid from flowing through a check valve located in the flow passage.

4. The method of claim 3, wherein the check valve is positioned at a lower end of the flow passage.

5. The method of claim 1, wherein the flowing fluid downhole comprises flowing a kill weight fluid.

6. The method of claim 1, wherein the preventing comprises preventing cement or a formation fluid from flowing uphole.

7. The method of claim 1, further comprising moving the gripping device when the fluid is flowing downhole to facilitate the fluid flow.

8. The method of claim 1, further comprising prior to the flowing, installing the flow passage with the casing string into the wellbore.

9. The method of claim 1, wherein the flow passage extends through an annular space positioned radially about the casing string.

10. The method of claim 1, further comprising measuring a property of the fluid flowing downhole.

11. A system for managing a well comprising a wellbore, comprising:

a flow passage external to and in fluid communication with a casing string;

a gripping device positioned within the flow passage to support the casing string and prevent the casing string from displacing within the wellbore; and a check valve positioned within the flow passage to prevent fluid from flowing from the casing string and through the flow passage.

12. The system of claim 11, wherein the check valve is positioned at a lower end of the flow passage.

13. The system of claim 11, wherein the gripping device is configured to move within the flow passage when the fluid is flowing downhole into the wellbore through the flow passage to facilitate the fluid flow.

14. The system of claim 11, wherein the flow passage extends through an annular space positioned radially about the casing string.

15. The system of claim 11, further comprising a sensor positioned within the flow passage to measure a property of the fluid flowing within the flow passage.

* * * * *